US008111014B2

(12) United States Patent
Van Erp et al.

(10) Patent No.: US 8,111,014 B2
(45) Date of Patent: Feb. 7, 2012

(54) DRIVE CIRCUIT FOR DRIVING A LOAD WITH CONSTANT CURRENT

(75) Inventors: Josephus Adrianus Maria Van Erp, Eindhoven (NL); Eric P. M. Verschooten, Duffel (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 374 days.

(21) Appl. No.: 12/306,394

(22) PCT Filed: Jun. 7, 2007

(86) PCT No.: PCT/IB2007/052161

§ 371 (c)(1), (2), (4) Date: Jan. 7, 2009

(87) PCT Pub. No.: WO2008/001246

PCT Pub. Date: Jan. 3, 2008

(65) Prior Publication Data

US 2009/0224695 A1 Sep. 10, 2009

(30) Foreign Application Priority Data

Jun. 26, 2006 (EP) ..... 06116028

(51) Int. Cl.
*H05B 37/02* (2006.01)

(52) U.S. Cl. ..... 315/307; 315/185 R; 315/297

(58) Field of Classification Search ..... 315/185 R, 315/224, 247, 291, 297, 307–308, 360; 323/280, 323/282, 304

See application file for complete search history.

(56) References Cited

U.S. PATENT DOCUMENTS

| | | | | |
|---|---|---|---|---|
| 6,040,663 | A * | 3/2000 | Bucks et al. | 315/291 |
| 6,529,182 | B1 | 3/2003 | Burton | |
| 7,265,504 | B2 * | 9/2007 | Grant | 315/308 |
| 7,276,861 | B1 * | 10/2007 | Shteynberg et al. | 315/291 |
| 7,511,437 | B2 * | 3/2009 | Lys et al. | 315/307 |

(Continued)

FOREIGN PATENT DOCUMENTS

DE 102006034371 A1 10/2007

(Continued)

OTHER PUBLICATIONS

"Dimming of Super High Brightness LEDs With L6902D", AN2129 Application Note, Date: Mar. 2, 2005.

*Primary Examiner* — Tung X Le
(74) *Attorney, Agent, or Firm* — Mark L. Beloborodov

(57) ABSTRACT

A drive circuit (1) for driving a load (3) comprises: a switched mode power supply (10) for supplying at the output (2*a*, 2*b*) a switched output current (IL); a controller (20) for controlling the power supply; a current sensor (15) for generating a current sense signal (Vi 5) representing the output current (IL); a voltage sensor (30) for generating a voltage sense signal (Sy) representing the output voltage (Vp; Vp+Vis) of the circuit. The controller receives the current sense signal, and generates a switching time control signal (Sc) for the switched mode power supply (10) on the basis of the current sense signal. The controller further receives the voltage sense signal. In response to a change in the voltage sense signal, the controller changes the switching time control signal such as to effectively compensate an effect of the output voltage change on the average value of the output current.

9 Claims, 4 Drawing Sheets

U.S. PATENT DOCUMENTS

| | | | | |
|---|---|---|---|---|
| 7,659,673 | B2 * | 2/2010 | Lys | 315/247 |
| 7,919,936 | B2 * | 4/2011 | Liu et al. | 315/307 |
| 2003/0117087 | A1 | 6/2003 | Barth et al. | |
| 2006/0001381 | A1 * | 1/2006 | Robinson et al. | 315/185 R |
| 2006/0022916 | A1 | 2/2006 | Aiello | |
| 2006/0113975 | A1 * | 6/2006 | Mednik et al. | 323/282 |

FOREIGN PATENT DOCUMENTS

| | | | |
|---|---|---|---|
| EP | 1643810 | A1 | 4/2006 |
| EP | 1648205 | A1 | 4/2006 |
| WO | 2006059437 | A1 | 6/2006 |
| WO | 2007016373 | A2 | 2/2007 |

* cited by examiner

DRIVE CIRCUIT FOR DRIVING A LOAD WITH CONSTANT CURRENT

This application is a national stage application under 35 U.S.C. §371 of International Application No. PCT/IB2007/052161 filed on Jun. 7, 2007, and published in the English language on Jan. 3, 2008, as International Publication No. WO/2008/001246, which claims priority to European Application No. 06116028.9 filed on Jun. 26, 2006, incorporated herein by reference.

FIELD OF THE INVENTION

The present invention relates in general to a drive circuit for a load, specifically for LED applications. More particularly, the present invention relates to a drive circuit comprising a switched mode power supply.

BACKGROUND OF THE INVENTION

LEDs are conventionally known as signaling devices. With the development of high-power LEDs, LEDs are nowadays also used for illumination applications. In such applications, it is important that the LED current is accurately kept at a certain target value, since the light output (intensity of the light) is proportional to the current. This applies especially in so-called multi-color applications, where a plurality of LEDs of different colors are used to generate a variable mixed color that depends on the respective intensities of the respective LEDs: a variation in the light intensity of one LED may result in an unwanted variation of the resulting mixed color.

Driver circuits for driving an arrangement of LEDs with substantially constant current are already known. Typically, such constant current driver circuit comprises a current sensor for sensing the LED current, and a sensor signal is fed back to a controller, which controls a power source such that the sensed current is substantially constant kept at a predetermined level.

Although such control system would normally function satisfactorily, a problem occurs in that the voltage developed over the LED may vary, and that as a result the power source may give an incorrect current. This problem occurs especially in case the power source is a switched mode power source.

The present invention aims to provide a drive circuit where this problem is overcome or at least reduced. More particularly, the present invention aims to provide a drive circuit which is less sensitive to variations in the forward voltage of the LEDs.

SUMMARY OF THE INVENTION

According to an important aspect of the invention, the driver circuit also comprises a voltage sensor for sensing the LED voltage, and a voltage sense signal is also fed back to the controller. In response to sensed voltage variations, the controller suitably adapts its control of the power source such that the actual LED current is maintained constant. In a particular embodiment, current control is performed by comparing the sensed current signal to a reference signal, and the reference signal is suitably amended in response to sensed voltage variations.

It is noted that US-2003/0.117.087 discloses a drive circuit for LEDs, where both the LED current and the LED voltage are measured and both measuring signals are used to control the LED driver. However, in the system described in said publication, control is aiming at keeping the current sense signal and the voltage sense signal constant. In contrast, according to the invention, a variation in the voltage sense signal is accepted, and in response a corresponding variation in the current sense signal is effected, such that the actual LED current remains constant.

BRIEF DESCRIPTION OF THE DRAWINGS

These and other aspects, features and advantages of the present invention will be further explained by the following description with reference to the drawings, in which same reference numerals indicate same or similar parts, and in which.

DETAILED DESCRIPTION OF THE INVENTION

Figure 1:
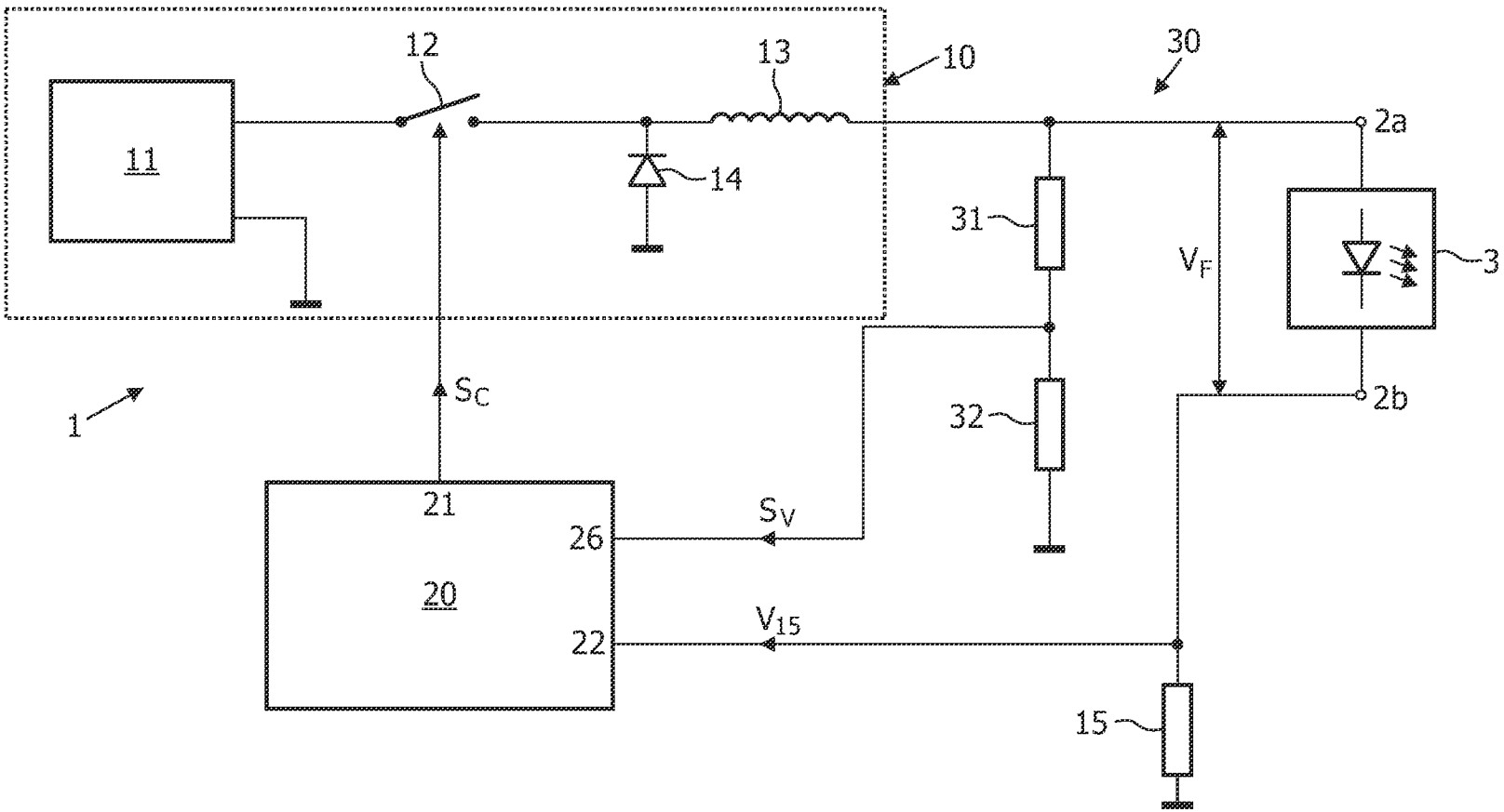
FIG. 1 is a block diagram schematically showing a driver circuit.

FIG. 1 is a block diagram schematically showing a driver circuit 1 having output terminals 2*a*, 2*b* for connection to a LED arrangement 3. It is noted that the LED arrangement 3 may consist of only one LED, but it is also possible that the LED arrangement comprises a plurality of LEDs arranged in series and/or in parallel. The driver circuit 1 further comprises a controllable switched mode power supply 10, and a controller 20 for controlling the power supply 10.

Switched mode power supplies are known per se, therefore the description of the exemplary switched mode power supply 10 illustrated in FIG. 1 will be kept brief. If fed from a mains supply, the power supply 10 comprises a converter 11 for converting alternating voltage to direct voltage. A controllable switch 12, for instance a transistor, is coupled to a first output terminal of the converter 11. An inductor 13, typically a coil, is coupled in series with the controllable switch 12. At the junction of the switch 12 and the inductor 13, a diode 14 is coupled to a second output terminal of the converter 11, while the opposite end of the inductor 13 is coupled to a first output terminal 2*a* of the driver circuit 1. A second output terminal 2*b* of the driver circuit 1 is coupled to the second output terminal of the converter 11.

The controller 20 has a control output 21 coupled to a control terminal of the switch 12, providing a switching time control signal Sc determining the operative state of the switch 12, more specifically determining the switching moments of the switch 12. The control output signal Sc is typically a block signal that is either HIGH or LOW. One value of the control output signal Sc, for instance HIGH, results in the switch 12 being closed (i.e. conductive): current flows from the converter 11 through the inductor 13 and the LED arrangement 3 back to the converter, while the current magnitude increases with time. The inductor 13 is being charged. The other value of the control output signal Sc, for instance LOW, results in the switch 12 being open (i.e. non-conductive). The inductor 13 tries to maintain the current, which now flows in the loop defined by the inductor 13, the LED arrangement 3 and the diode 14, while the current magnitude decreases with time. The inductor 13 is being discharged.

Figure 2:
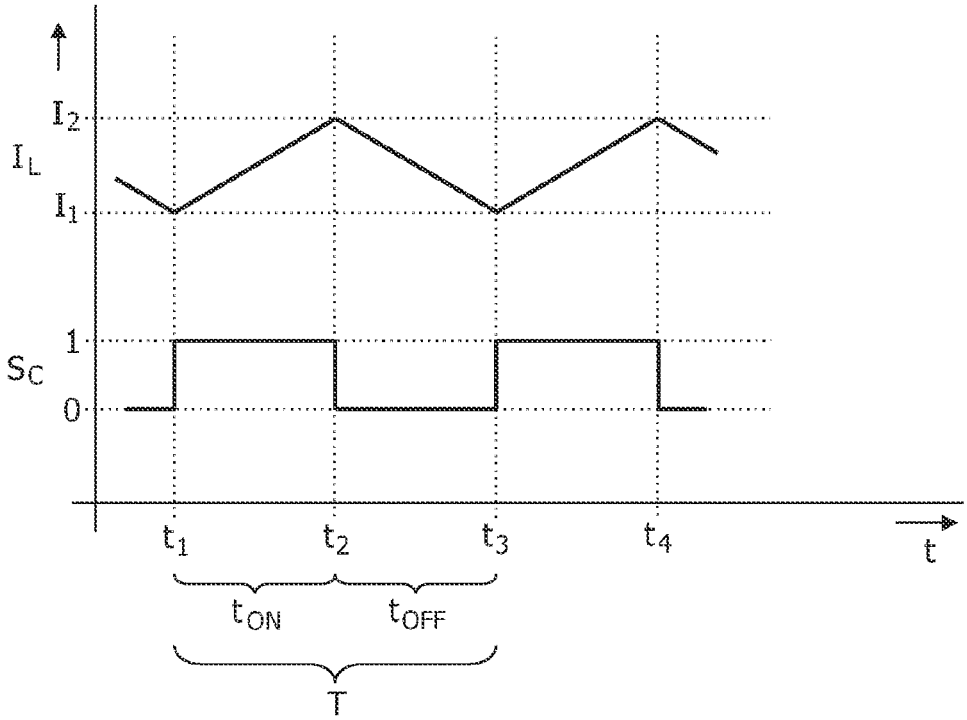
FIG. 2 is a graph schematically illustrating a waveform of an output current provided by the driver circuit of FIG. 1.

FIG. 2 is a graph illustrating this operation. At times $t_1$ and $t_3$, the control output signal Sc becomes HIGH and the output current $I_L$ through the LEDs starts to rise. At times $t_2$ and $t_4$, the control output signal Sc becomes LOW and the output current $I_L$ through the LEDs starts to decrease. The time interval from $t_1$ to $t_2$ will be indicated as ON-duration $t_{ON}$. The time interval from $t_2$ to $t_3$ will be indicated as OFF-duration $t_{OFF}$. The sum of $t_{ON}$ and $t_{OFF}$ is the current period T.

At times $t_1$ and $t_3$, the output current $I_L$ has a minimum magnitude 11, while at times $t_2$ and $t_4$, the output current $I_L$ has a maximum magnitude 12. The average output current $I_{AV}$ is a value between $I_1$ and $I_2$, depending on the ratio of $t_{ON}$ and $t_{OFF}$, or the duty cycle Δ defined as $t_{ON}/T$. Assuming that the current magnitude rises and falls linearly with time, the average output current $I_{AV}$ is given by the following formula:

$$I_{AV}=(I_1+I_2)/2 \tag{1}$$

In general, times when the control output signal Sc becomes HIGH, such as $t_1$ and $t_3$, will be indicated as SWITCH_ON-times $t_{SON}$, and times when the control output signal Sc becomes LOW, such as $t_2$ and $t_4$, will be indicated as SWITCH_OFF-times $t_{SOFF}$. The controller 20 determines the SWITCH_ON-times $t_{SON}$ and SWITCH_OFF-times $t_{SOFF}$ on the basis of the momentary value of the LED current $I_L$. To this end, the driver circuit 1 comprises a current sensor 15, in the exemplary embodiment of FIG. 1 implemented as a resistor connected in series with the LED arrangement 3 between the second output terminal 2*b* and mass. The LED current $I_L$ results in a voltage drop $V_{15}$ over the current sense resistor 15 proportional to the LED current $I_L$. The voltage $V_{15}$ constitutes a current measuring signal, which is provided to the controller 20 at a current sense input 22. The controller 20 further comprises a comparator 23 and a threshold voltage source 24. The comparator 23 has a first input receiving the threshold voltage $V_{TH}$ from the threshold voltage source 24, and a second input receiving the current measuring signal $V_{15}$ from current sense input 22. The output signal Scomp from the comparator 23 is coupled to a monopulse generator 25, whose output, possibly after further amplification, constitutes the switch control signal Sc.

There are several types of operation possible for the controller 23. It is possible that the controller 23 makes its switch control signal Sc LOW when the current measuring signal $V_{15}$ becomes higher than the threshold voltage $V_{TH}$, and that the OFF-duration $t_{OFF}$ has a fixed value. In that case, the output signal of the monopulse generator 25 is normally HIGH and the monopulse generator 25, on triggering, generates a LOW pulse with duration $t_{OFF}$. It is also possible that the controller 23 makes its switch control signal Sc HIGH when the current measuring signal $V_{15}$ becomes lower than the threshold voltage $V_{TH}$, and that the ON-duration $t_{ON}$ has a fixed value. In that case, the output signal of the monopulse generator 25 is normally LOW and the monopulse generator 25, on triggering, generates a HIGH pulse with duration $t_{ON}$. It is further possible that the controller 23 is provided with two comparators and two threshold voltage sources of mutually different threshold voltages, one comparator comparing the current measuring signal with one threshold voltage and the other comparator comparing the current measuring signal with the other threshold voltage, wherein the controller 23 makes its switch control signal Sc HIGH when the current measuring signal $V_{15}$ becomes lower than the lowest threshold voltage and wherein the controller 23 makes its switch control signal Sc LOW when the current measuring signal $V_{15}$ becomes higher than the highest threshold voltage (hysteresis control). All of these types of operation result in a current waveform as illustrated in FIG. 2.

When a LED is driven with a LED current $I_L$, a voltage drop occurs over the LED, which voltage drop is indicated as forward voltage $V_F$. The magnitude of the forward voltage $V_F$ is a device property of the LED, and is substantially independent of the magnitude of the LED current $I_L$. However, this device property may change over time, for instance through ageing or as a function of temperature. Also, the device property may be different in different LEDs. Further, it may be desirable to change the number of LEDs in the LED arrangement, also resulting in a change of forward voltage $V_F$. A problem is, that the average LED current $I_{AV}$ depends on the forward voltage $V_F$, so a change in the forward voltage $V_F$ may cause a change in the average LED current which is not noticed by the controller 20 from monitoring the current sensor 15. This can be understood as follows for the case of a controller operating with constant tOFF duration.

Switch 12 is switched OFF when the measured current signal $V_{15}$ is equal to the threshold voltage $V_{TH}$, therefore $$I_2=V_{TH}/R\text{sense} \tag{2}$$

Rsense being the resistance value of the sense resistor 15.

During an OFF-interval, the LED current is provided by the inductor 13. The voltage over the inductor 13 will be indicated as $V_{13}$. Ignoring the voltage drop over the diode 14, $V_{13}$ is equal to the sum of $V_F$ and $V_{15}$:

$$V_{13}=V_F+V_{15} \tag{3}$$

The current through the inductor will decrease as a function of time in accordance with the following formula:

$$\Delta I_L=-V_{13}\cdot\Delta t/L \tag{4}$$

wherein L indicates the inductance of the inductor 13.

In a first approximation, for brief $t_{OFF}$, it may be assumed that $V_{13}$ is constant. Thus, the value of $I_1$ can be approximated according to the following formula:

$$I_1=I_2+\Delta I_L=V_{TH}/R\text{sense}-V_{13}\cdot t_{OFF}/L \tag{5}$$

Using formulas (1) and (3), the average current $I_{AV}$ can be expressed as $$I_{AV}=V_{TH}/R\text{sense}-V_{TH}\cdot t_{OFF}/2L-V_F\cdot t_{OFF}/2L \tag{6}$$

For the case of a controller operating with constant $t_{ON}$ duration, or for the case of a controller operating with two threshold voltages, similar formulas can be derived.

In all cases, the relationship between the average current and the forward voltage $V_F$ can, in first approximation, be expressed as $$I_{AV}=I(0)+c\cdot V_F \tag{7}$$

I(0) being a constant value not depending on $V_F$, and c being a constant, whose value, which may be positive or negative, can be determined in advance.

From formula (7), the following relationship can be derived:

$$dI_{AV}/dV_F=c \tag{8}$$

According to the invention, the driver circuit 1 is designed to compensate for the dependency of formula (8). To this end, the driver circuit 1 further comprises a voltage sensor 30 arranged for providing a measuring signal $S_V$ representing the forward voltage $V_F$, which measuring signal $S_V$ is received by the controller 20 at a voltage sense input 26. In the exemplary embodiment illustrated in FIG. 1, the voltage sensor 30 is implemented as a series arrangement of two resistors 31, 32 connected between first output terminal 2*a* and mass, the measuring signal $S_V$ being taken from the node between said two resistors 31, 32. It is noted that this measuring signal $S_V$ actually represents $V_F+V_{15}$, but the controller 20 already knows V15 from the signal received at its current sense input 22 so the controller can easily derive VF by performing a subtraction operation $V_F=S_V-V_{15}$, illustrated by a subtractor 27 in FIG. 3. Alternatively, different possibilities for arranging a voltage sensor which actually measures the voltage between the output terminals 2*a*, 2*b* can easily be found, such as a sensor connected between the output terminals 2*a*, 2*b*, but the embodiment shown has the advantage of simplicity.

On the other hand, with reference to formula (5), it is noted that the average current $I_{AV}$ can actually be expressed as $$I_{AV}=V_{TH}/R\text{sense}-(V_F+V_{15})\cdot t_{OFF}/2L \quad (9)$$

$$=I(0)+c'\cdot S_V \quad (10)$$

In response to the measuring signal $S_V$, the controller 20 is designed to adapt the timing of its control signal Sc such that the actual average current $I_{AV}$ remains unaffected. For implementing this compensation action, there are several possibilities.

Figure 3:
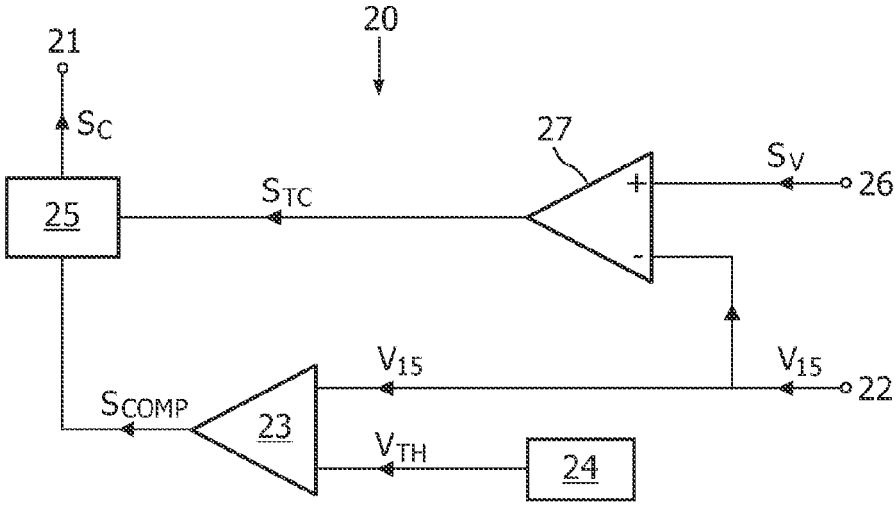
FIGS. 3-6 are block diagrams schematically illustrating preferred details of a controller according to the present invention.

In a possible embodiment, in a case where the OFF-duration $t_{OFF}$ is constant, the controller 20 is designed to change the OFF-duration $t_{OFF}$ in response to variations in the forward voltage $V_F$. From formula (6) or (9), it can easily be seen that an increase in $V_F$ can be counteracted by a decrease in $t_{OFF}$ while a decrease in $V_F$ can be counteracted by an increase in $t_{OFF}$. Likewise, in a case where the ON-duration $t_{ON}$ is constant, the controller 20 can be designed to change the ON-duration $t_{ON}$ in response to variations in the forward voltage $V_F$. These embodiments are illustrated in FIG. 3, where the monopulse generator 25 is shown as a controllable generator which is controlled by a timing control signal Stc derived from the voltage sense signal $S_V$.

Figure 4:
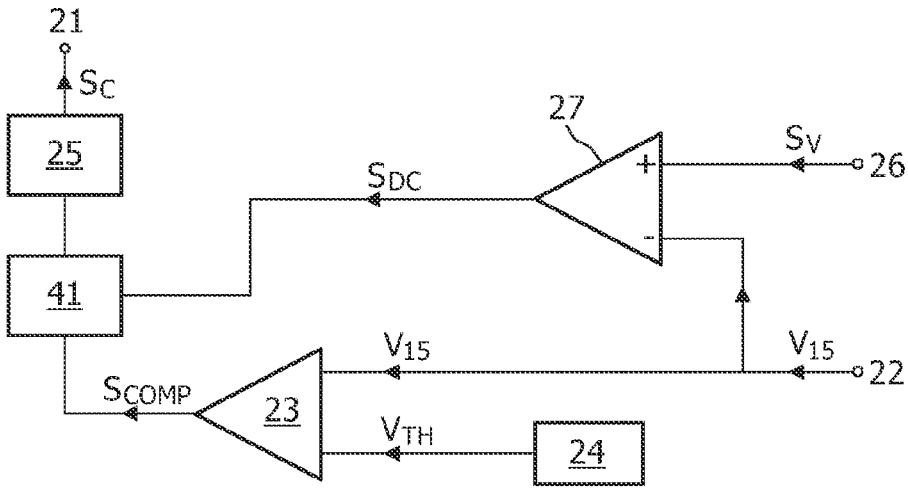

It is also possible that the timing of the comparator output signal Scomp is changed. From the above formulas, it can easily be seen that an increase in $V_F$ can be counteracted by an increase in $I_2$, which can be effected by an added delay to the comparator output signal Scomp. FIG. 4 is a block diagram comparable to FIG. 3, showing an embodiment where the controller 20 comprises a controllable delay 41 arranged between the comparator 23 output and the monopulse generator 25, which controllable delay 41 is controlled by a delay control signal Sdc derived from the voltage sense signal $S_V$. This approach can also be used in an embodiment comprising two threshold voltage sources and two comparators for hysteresis control. It is noted that the above applies in cases where, in formula (7) or (10), c or c', respectively, is negative; if c or c', respectively, is positive, an increase in $V_F$ can be counteracted by a decrease in $I_2$, which can be effected by a reduced delay in the comparator output signal Scomp.

It is also possible that the timing of the comparator is changed by changing its input signals. From formula (6) or (9), it can easily be seen that an increase in $V_F$ can be counteracted by an increase in $V_{TH}$, also resulting in an increased 12. A similar effect can be achieved by decreasing the current sense signal $V_{15}$. It is noted that the above applies in cases where, in formula (7) or (10), c or c', respectively, is negative; if c or c', respectively, is positive, an increase in $V_F$ can be counteracted by a decrease in $V_{TH}$ and/or increasing the current sense signal $V_{15}$. Possible embodiments are illustrated in the block diagrams of FIGS. 5 and 6.

Figure 5:
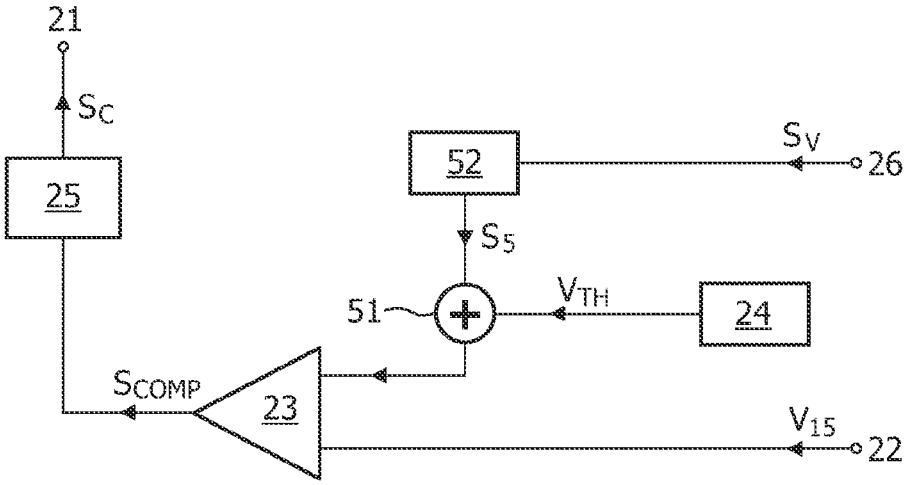

FIG. 5 shows an embodiment where the controller 20 comprises an adder 51 and a compensation block 52 receiving the voltage sense signal $S_V$ and deriving a compensation signal $S_5$ from the voltage sense signal Sv, which compensation signal $S_5$, being positive or negative, is supplied to one input terminal of the adder 51 while another input terminal receives the threshold voltage $V_{TH}$ from the threshold voltage generator 24. Alternatively, the threshold voltage generator 24 may be a controllable generator, controlled by the compensation signal $S_5$ to vary the threshold voltage $V_{TH}$.

Figure 6:
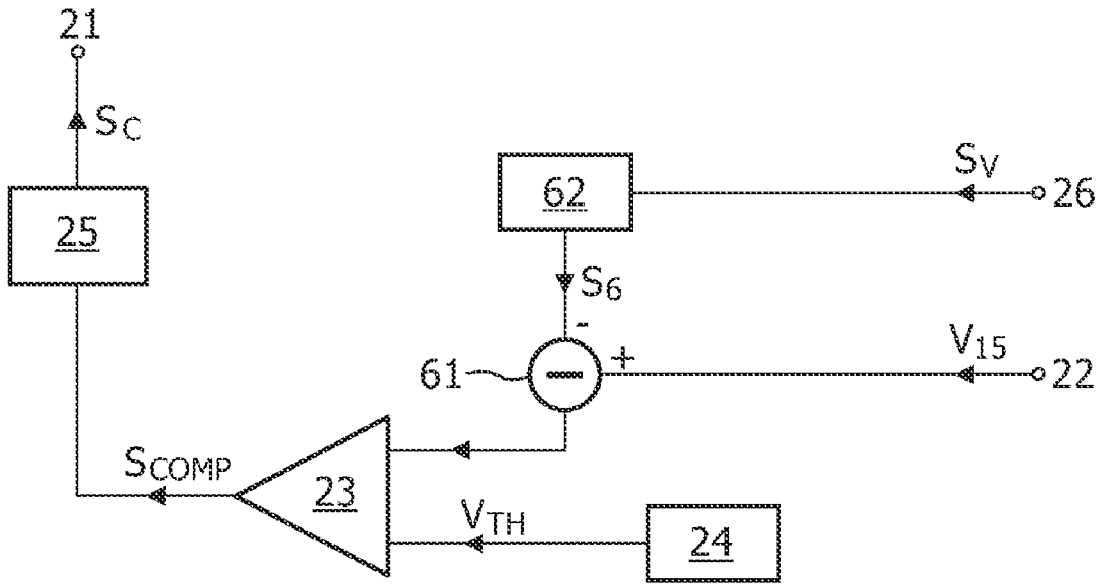

FIG. 6 shows an embodiment where the controller 20 comprises a subtractor 61 and a compensation block 62 receiving the voltage sense signal Sv and deriving a compensation signal $S_6$ from the voltage sense signal Sv, which compensation signal $S_6$, being positive or negative, is supplied to one input terminal of the subtractor 61 while another input terminal receives the current sense signal $V_{15}$ from current sense input 22.

In the above embodiments, the controller 20 controls the moments of switching the switch 12 OFF, while the OFF-duration $t_{OFF}$ is constant. In embodiments where the controller 20 controls the moments of switching the switch 12 ON while the ON-duration $t_{ON}$ is constant, an increasing output voltage should also be compensated by a delayed switching moment, which is now achieved by decreasing the threshold voltage or increasing the current sense signal.

With reference to the above formulas, it is noted that the compensation signal $S_5$ or $S_6$, respectively, may be considered to depend from the voltage sense signal Sv in a linear way. Even if the circuit is not completely linear, a linear compensation will usually be sufficient in practice. In case of a suitable dimensioning, the voltage sense signal Sv can be applied to adder 51 or subtractor 61 directly, and the compensation block may be omitted.

It should be clear to a person skilled in the art that the present invention is not limited to the exemplary embodiments discussed above, but that several variations and modifications are possible within the protective scope of the invention as defined in the appending claims.

For instance, in the above several types of controller have been described by way of example, but the present invention can also be implemented with different types of controller; for example, the present invention can also be implemented with a peak detect PWM controller. In a general solution, compensation can take place by adding or subtracting a signal to or from the current sense signal or the reference threshold level, proportional to the load output voltage.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. A drive circuit for driving a load, the circuit comprising:
- an output for connecting the load;
- a switched mode power supply for supplying at the output a switched output current which increases during ON-intervals and decreases during OFF-intervals;
- a controller for controlling the switched mode power supply;
- a current sensor for generating a current sense signal representing the output current; and
- a voltage sensor for generating a voltage sense signal representing the output voltage of the circuit; wherein the controller comprises:
  - a current sense input receiving the current sense signal, the controller being configured to generate a switching time control signal for the switched mode power supply on the basis of the received current sense signal;
  - a voltage sense input receiving the voltage sense signal; wherein the controller is configured, in response to a change in the received voltage sense signal representing a change in the output voltage, to change the switching time control signal to effectively compensate an effect of the output voltage change on the average value of the output current;

at least one threshold voltage generator for generating a threshold voltage; and at least one comparator having a first input receiving a signal equal to or derived from the threshold voltage and a second input receiving a signal equal to or derived from the current sense signal, the controller being configured to generate the switching time control signal so as to indicate a transition moment from an ON-interval to an OFF-interval on the basis of an output signal of the comparator;

to change the transition moment in proportion to a change in the received voltage sense signal, so as to delay said transition moment, if the received voltage sense signal increases and to advance said transition moment if the received voltage sense signal decreases; and wherein the controller further comprises a controllable delay between said comparator and said control output, said controllable delay being controlled by a signal equal to or derived from the received voltage sense signal.

2. A drive circuit according to claim 1, wherein the duration of the OFF-intervals is constant.

3. A drive circuit according to claim 1, wherein the controller further comprises an adder arranged between said threshold voltage generator and said comparator for receiving a signal equal to or derived from the received voltage sense signal.

4. A drive circuit according to claim 1, wherein the controller further comprises a subtractor arranged between said current sense input and said comparator for receiving a signal equal to or derived from the received voltage sense signal.

5. A drive circuit for driving a load, the circuit comprising:

an output for connecting the load;

a switched mode power supply for supplying at the output a switched output current which increases during ON-intervals and decreases during OFF-intervals;

a controller for controlling the switched mode power supply;

a current sensor for generating a current sense signal representing the output current; and a voltage sensor for generating a voltage sense signal representing the output voltage of the circuit; wherein the controller comprises:

a current sense input receiving the current sense signal, the controller being configured to generate a switching time control signal for the switched mode power supply on the basis of the received current sense signal;

a voltage sense input receiving the voltage sense signal; wherein the controller is configured, in response to a change in the received voltage sense signal representing a change in the output voltage, to change the switching time control signal to effectively compensate an effect of the output voltage change on the average value of the output current;

at least one threshold voltage generator for generating a threshold voltage;

at least one comparator having a first input receiving a signal equal to or derived from the threshold voltage a second input receiving a signal equal to or derived from the current sense signal; the controller being configured to to generate the switching time control signal so as to indicate a transition moment from an OFF-interval to an ON-interval on the basis of an output signal of the comparator to change the transition moment in proportion to a change in the received voltage sense signal, so as to delay said transition moment if the received voltage sense signal increases and to advance said transition moment, if the received voltage sense signal decreases, wherein the controller further comprises a controllable delay between said comparator and said control output, said controllable delay being controlled by a signal equal to or derived from the received voltage sense signal.

6. A drive circuit according to claim 5, wherein the duration of the ON-intervals is constant.

7. A drive circuit according to claim 5, wherein the controller further comprises a subtractor arranged between said threshold voltage generator and said comparator for receiving a signal equal to or derived from the received voltage sense signal.

8. A drive circuit according to claim 5, wherein the controller further comprises an adder arranged between said current sense input and said comparator for receiving a signal equal to or derived from the received voltage sense signal.

9. A method for compensating a switched mode power supply generating a switched output current for a load, wherein the output current is sensed and the current sense signal is compared with a reference threshold level and the switched mode power supply is controlled on the basis of the outcome of the comparison; the method comprising the steps of:

generating a compensation signal proportional to the load output voltage (Vp); and before performing said comparison, adding said compensation signal to the current sense signal or the reference threshold level, or subtracting said compensation signal from the current sense signal or the reference threshold level.

* * * * *